US010471975B2

(12) United States Patent
Zhang et al.

(10) Patent No.: US 10,471,975 B2
(45) Date of Patent: Nov. 12, 2019

(54) RAILWAY VEHICLE AND DERAILMENT SAFETY DEVICE THEREOF

(71) Applicant: CRRC QINGDAO SIFANG CO., LTD., Qingdao, Shandong (CN)

(72) Inventors: Zhenxian Zhang, Shandong (CN); Lijun Ma, Shandong (CN); Xiaolong Zou, Shandong (CN); Rongsheng Kuai, Shandong (CN); Zhibo Zhang, Shandong (CN)

(73) Assignee: CRRC QINGDAO SIFANG CO., LTD., Qingdao, Shandong (CN)

( * ) Notice: Subject to any disclaimer, the term of this patent is extended or adjusted under 35 U.S.C. 154(b) by 386 days.

(21) Appl. No.: 15/504,940

(22) PCT Filed: Nov. 16, 2015

(86) PCT No.: PCT/CN2015/094662
§ 371 (c)(1),
(2) Date: Feb. 17, 2017

(87) PCT Pub. No.: WO2016/124029
PCT Pub. Date: Aug. 11, 2016

(65) Prior Publication Data

US 2017/0284032 A1 Oct. 5, 2017

(30) Foreign Application Priority Data

Feb. 5, 2015 (CN) ..... 2015 1 0061553
Feb. 5, 2015 (CN) ..... 2015 2 0083972 U

(51) Int. Cl.
*B61F 9/00* (2006.01)
*E01B 5/18* (2006.01)

(52) U.S. Cl.
CPC . *B61F 9/00* (2013.01); *E01B 5/18* (2013.01)

(58) Field of Classification Search
CPC ..... B61F 9/00; E01B 5/18
(Continued)

(56) References Cited

U.S. PATENT DOCUMENTS 493,662 A * 3/1893 Spearing ..... B60T 7/124 246/172
556,723 A * 3/1896 Kneedler et al. ..... B61H 7/02 188/41

(Continued)

FOREIGN PATENT DOCUMENTS

CN 101400559 A 4/2009
CN 201427587 Y 3/2010

(Continued)

OTHER PUBLICATIONS

International Search Report for PCT/CN2015/094662, dated Feb. 25, 2016, ISA/CN.

*Primary Examiner* — Zachary L Kuhfuss
(74) *Attorney, Agent, or Firm* — Yue (Robert) Xu; Apex Attorneys at Law, LLP

(57) ABSTRACT

An anti-derailment safety device is in a shape of an inverted letter L and includes a transverse portion and a longitudinal portion perpendicular to the transverse portion at a side below the transverse portion; two sides of the transverse portion in a width direction of the transverse portion are each provided with an installation seat formed by a wing plate extending outwardly, and bolt holes are provided on the installation seat; and an inner side surface of the longitudinal portion is a stopping surface.

12 Claims, 5 Drawing Sheets

(58) Field of Classification Search
USPC ..... 104/242; 105/216
See application file for complete search history.

(56) References Cited

U.S. PATENT DOCUMENTS

| | | | | | |
|---|---|---|---|---|---|
| 735,239 | A * | 8/1903 | Gehricke et al. | B61F 9/00 105/216 |
| 745,285 | A * | 11/1903 | Lockwood | B61H 11/14 105/216 |
| 777,190 | A | 12/1904 | Edwards | |
| 945,140 | A * | 1/1910 | Ruckert | B61F 9/00 105/216 |
| 953,781 | A * | 4/1910 | Edwards | B61F 9/00 104/242 |
| 1,626,610 | A | 5/1927 | Hornquist | |
| 2,227,733 | A * | 1/1941 | McCormick | B61F 5/52 104/242 |
| 2,319,466 | A * | 5/1943 | McCormick | B61F 9/00 104/242 |
| 2,431,062 | A | 11/1947 | McCormick | |
| 2006/0124024 | A1 | 6/2006 | Hachikawa | |
| 2009/0301343 | A1 | 12/2009 | Sakanoue et al. | |
| 2016/0362120 | A1* | 12/2016 | Ma | B61F 5/24 |
| 2017/0284032 | A1* | 10/2017 | Zhang | E01B 5/18 |
| 2018/0208218 | A1* | 7/2018 | Gao | B61F 5/50 |

FOREIGN PATENT DOCUMENTS

| | | | |
|---|---|---|---|
| CN | 201633743 | U | 11/2010 |
| CN | 102233881 | A | 11/2011 |
| CN | 102414071 | A | 4/2012 |
| CN | 202225875 | A | 5/2012 |
| CN | 203439052 | U | 2/2014 |
| CN | 104627195 | A | 5/2015 |
| CN | 204548142 | U | 8/2015 |
| FR | 2755658 | B1 | 5/1998 |
| JP | H110250576 | A | 9/1998 |
| JP | 2008201372 | A | 9/2008 |
| JP | 2006315518 | A | 11/2016 |

* cited by examiner

RAILWAY VEHICLE AND DERAILMENT SAFETY DEVICE THEREOF

This application is the national phase of International Application No. PCT/CN2015/094662, titled "RAILWAY VEHICLE AND DERAILMENT SAFETY DEVICE THEREOF", filed on Nov. 16, 2015, which claims the benefit of priorities to Chinese patent application No. 201510061553.2 titled "RAILWAY VEHICLE AND ANTI-DERAILMENT SAFETY DEVICE THEREOF", filed with the Chinese State Intellectual Property Office on Feb. 5, 2015, and Chinese patent application No. 201520083972.1 titled "RAILWAY VEHICLE AND ANTI-DERAILMENT SAFETY DEVICE THEREOF", filed with the Chinese State Intellectual Property Office on Feb. 5, 2015, the entire disclosures of which are incorporated herein by reference.

FIELD

The present application relates to the technical field of railway vehicles, in particular to an anti-derailment safety device of the railway vehicle. The present application also relates to a railway vehicle having the anti-derailment safety device.

BACKGROUND

At present, derailments of a railway vehicle happen occasionally domestic and overseas. An excessive transverse displacement of the train after the train is derailed is apt to cause a rollover of the train, which causes a heavy loss of life and property. Especially on a viaduct, with the limitation of a width of a bridge floor, the train may even fall into a riverway or fall off a cliff if the amplitude of the transverse displacement is excessive, which may cause a severe consequent.

The anti-derailment safety device is designed for avoiding the accidents which are caused by an excessive transverse displacement of wheels after the train is derailed.

A transverse displacement limitation system for a bogie is disclosed in a patent application Publication No. CN 101400559Y. The system is consisted of anti-derailment protection devices placed along inner sides of a pair of rails respectively and a transverse displacement limitation device arranged at a lower portion of the bogie. The transverse displacement limitation device includes a limiter, and the limiter protrudes downward at a position close to the inner side with respect to the wheel of the bogie. When the train runs normally, the limiter does not contact the anti-derailment protection device; and when the train is derailed, the limiter is in a sliding contact with an inner side surface of the anti-derailment protection device.

A transverse displacement limitation device for a bogie is disclosed in a patent application Publication No. CN 102414071A. The device is provided with an anti-derailment protection device along an inner side of the rail and a limiter which is close to the inner side with respect to a wheel of the bogie and is in a sliding contact with the inner side surface of the transverse displacement limitation device. The limiter is provided with a sliding contact portion and a guiding portion. The sliding contact portion has a sliding contact surface which is in a sliding contact with the inner side surface of the anti-derailment protection device. The guiding portion extends respectively from a front portion and a rear portion of the sliding contact portion and has a guiding slope, the guiding slope has a front end inclined towards a direction away from the inner side surface of the anti-derailment protection device and a base in connection with the sliding contact surface. When the train runs normally, the limiter does not contact the anti-derailment protection device; and when the train is derailed, the limiter is in a sliding contact with the inner side surface of the anti-derailment protection device.

The two transverse displacement limitation devices for the bogie can limit the transverse displacement of the derailed bogie in a certain degree, however, the anti-derailment protection device is required to be installed at the inner side of the rail, that is, an auxiliary rail is required. It is equivalent to set two sets of rails, one set of rails is used to support the wheels to realize a running function and the other set of rails is used to cooperate with the limiter to function as a stopper when the train is derailed. This structure is too complicated and the cost is too high, thus it is difficult to realize an industrialized application. In addition, the limiter is located at a center position below the frame, and when the train is derailed, the train has to move transversely by at least one half of the width of the train body to come into contact with the limiter, the transverse displacement is too large and the security protection performance is poor, thus this structure can not meet higher security protection requirements.

A bogie frame for a vehicle is disclosed in a utility model Publication No. CN 203439052A, and includes a side sill, an end sill and a draft sill which are all welded, and further includes an anti-derailment protection strip. The derailment protection strip is connected below the end sill by an installation seat, the installation seat is welded to the bottom of the end sill, and the derailment protection strip is welded on the installation seat.

Compared with the two above manners, the derailment protection strips of this anti-derailment safety device limit the transverse displacement by contacting the rails when the train is derailed, and it is not required to place the auxiliary rails. The derailment protection strips are bilaterally symmetrical and respectively correspond to two rails, and are close to the rails, thus when the train is derailed, the derailment protection strips can come into contact with the rails in a short time and a short distance, which can increase the security protection performance when the train is accidentally derailed.

However, the derailment protection strip has a too complicated structure and a long length, thus occupying too much space below the train and then affecting the arrangement and installation of other underfloor devices. In addition, the derailment protection strip is required to be welded below the end sill by the installation seats at a front end and a rear end of the derailment protection strip, and the installation seat has a box-shaped structure, thus also having defects such as the structure is complicated and the volume is too large.

Thus, on the premise of ensuring the security performance, an urgent technical problem to be resolved by the person skilled in the art is to optimize the design of the anti-derailment safety device.

SUMMARY

A first object of the present application is to provide an anti-derailment safety device. The safety device has a simple structure, a small volume and a light weight, and is easy to be installed and replaced. The device has a reasonable structural design, and the contact manner between the device and the rail is stable and reliable, and the force performance of the device when in contact with rail is stable and reliable, thereby significantly increasing the security protection level of the train.

A second object of the present application is to provide a railway vehicle having the anti-derailment safety device.

For achieving the above objects, an anti-derailment safety device is provided according to the present application, which is in a shape of an inverted letter L, and includes a transverse portion and a longitudinal portion perpendicular to the transverse portion at a side below the transverse portion; two sides of the transverse portion in a width direction of the transverse portion are each provided with an installation seat formed by a wing plate extending outwardly, and bolt holes are provided on the installation seat; and an inner side surface of the longitudinal portion is a stopping surface.

Preferably, the transverse portion is a transverse stopping plate, the longitudinal portion is a vertical stopping plate, and the transverse stopping plate and the vertical stopping plate are formed as an integrated structure.

Preferably, a thickness of the wing plate is smaller than a thickness of the transverse portion, and a top surface of the wing plate and a top surface of the transverse portion are located in a same plane.

Preferably, the stopping surface inclines inward by 3 degrees to 5 degrees in a longitudinal direction from an end portion to a root portion.

Preferably, the stopping surface inclines inward by 4 degrees in the longitudinal direction from the end portion to the root portion.

Preferably, a lower surface of the transverse portion is provided with a concave portion, a radian of a contact section of the concave portion is equal to a radian of a top surface of a rail, and the concave portion smoothly transits to the stopping surface by a circular arc portion at an intersection of the transverse portion and the longitudinal portion.

Preferably, a radius of the arc concave portion is 80 mm.

Preferably, a width of an end portion of the longitudinal portion is smaller than a width of a body portion of the longitudinal portion, and a transition inclined surface or a transition arc surface is provided between the end portion of the longitudinal portion and each of lateral surfaces at two sides of the end portion.

For achieving the second object, a railway vehicle is further provided according to the present application, which includes a train body, a bogie and anti-derailment safety devices, the anti-derailment safety devices are the anti-derailment safety device according to any one of the above solutions, and the anti-derailment safety devices are symmetrically fixed at lower portions of axle box bodies of the bogie by bolts.

Preferably, in a height direction, a distance between a tail end of the longitudinal portion and a top surface of a rail ranges from 90 mm to 100 mm, inclusive.

According to researches on the derailment principle and the derailment protection technology, a brand new anti-derailment safety device is designed by the present application. Under the premise of meeting the function requirement of preventing the derailment of the train, a structural design is conducted on the condition that a contact portion of the device and the rail is the most reasonable portion, to allow the device to have the minimum effect on the security of the rail. At the same time, boundary dimension of the device is optimized to meet the strength requirement for preventing the derailment of the train, and the anti-derailment device is installed at the lower portion of the axle box body by the bolted connection, thus is located within the gauge of the railway vehicle. The anti-derailment device has a simple structure, is easy to install and occupies a small space. The distance between the stopping surface and the outer side surface of the wheel and the distance between the stopping surface and the rail surface are safe and reasonable. In a normal state, the anti-derailment device does not contact the rail and does not affect the normal running of the train. Only when the train is derailed, the anti-derailment device contacts the rail, to effectively restrict the wheel set from further moving transversely and rolling laterally after the train is derailed, and effectively restrain the position of the derailed train from getting worse or prevent the derailed train from getting overturned.

The railway vehicle provided by the present application includes the above-mentioned anti-derailment safety device, and the anti-derailment safety device has the above-mentioned technical effect, therefore the railway vehicle having the anti-derailment safety device also has the corresponding technical effect.

BRIEF DESCRIPTION OF THE DRAWINGS

For more clearly illustrating embodiments of the present application or the technical solution in the conventional technology, drawings referred to describe the embodiments or the conventional technology will be briefly described hereinafter. Apparently, the drawings in the following description are only several embodiments of the present application, and for the person skilled in the art, other drawings may be obtained based on these drawings without any creative efforts.

REFERENCE NUMERALS IN FIGS. 1 TO 5

Figure 1:
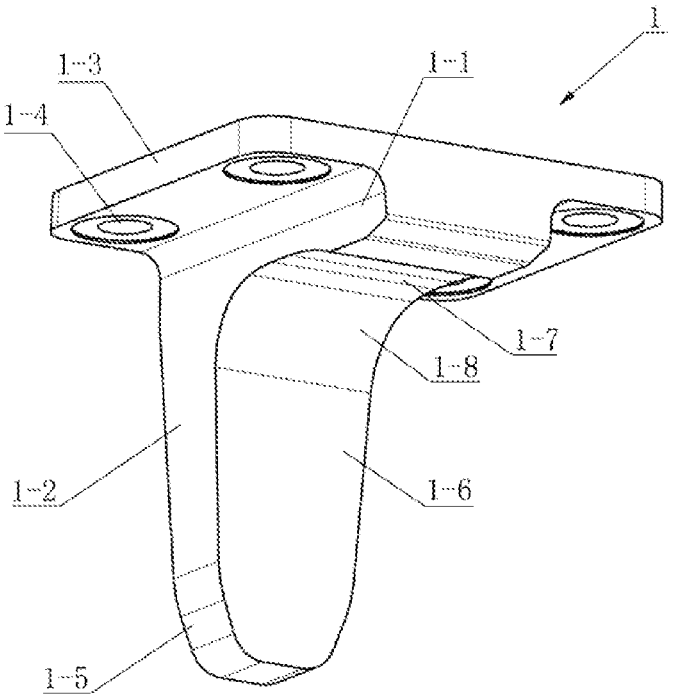
FIG. 1 is a perspective view showing an anti-derailment safety device according to a specific embodiment of the present application.

| | | | |
|---|---|---|---|
| 1 | anti-derailment block, | 1-1 | transverse portion, |
| 1-2 | longitudinal portion, | 1-3 | wing plate, |
| 1-4 | bolt hole, | 1-5 | arc surface, |
| 1-6 | stopping surface, | 1-7 | concave portion, |
| 1-8 | circular arc portion, | 2 | bolt, |
| 3 | axle box body, | 4 | wheel, |
| 5 | rail. | | |

DETAILED DESCRIPTION

For making the objects, technical solutions and advantages of embodiments of the present application clearer, the technical solutions in the embodiments of the present application will be described clearly and completely hereinafter in conjunction with the drawings in the embodiments of the present application. Apparently, the described embodiments are only a part of the embodiments of the present application, rather than all embodiments. Based on the embodiments in the present application, all of other embodiments, made by the person skilled in the art without any creative efforts, fall into the scope of protection of the present application.

Terms such as "up", "down", "left" and "right" in the present application are defined on basis of a positional relationship shown in the drawings. A corresponding positional relationship may also change with different drawings. Therefore, the terms can not be understood as an absolute restriction to the scope of protection.

Figure 2:
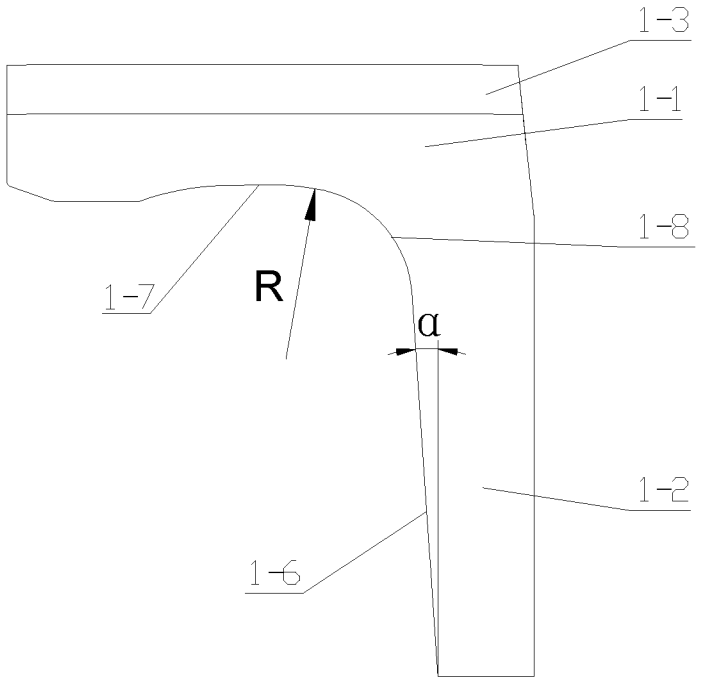
FIG. 2 is side view of the anti-derailment safety device as shown in FIG. 1.

Reference is made to FIGS. 1 and 2, wherein FIG. 1 is a perspective view showing an anti-derailment safety device according to a specific embodiment of the present application, and FIG. 2 is side view of the anti-derailment safety device as shown in FIG. 1.

In a specific embodiment, the anti-derailment safety device according to the present application is embodied as an inverted L-shaped anti-derailment block 1, which can be divided into a thick transverse portion 1-1 and a thick longitudinal portion 1-2. The thick longitudinal portion 1-2 is perpendicular to the transverse portion 1-1 at one side below the transverse portion 1-1, and when viewed from the side, the anti-derailment block 1 is in a shape of an inverted letter "L". Of cause, the term of "inverted" is used for describing the structure of the anti-derailment block more conveniently, and is corresponding to an installation condition of the anti-derailment block 1. If the anti-derailment block 1 is turned upside down by 180 degrees, the anti-derailment block 1 can be described as having an L shape.

Specifically, the transverse portion 1-1 is a transverse stopping plate, the longitudinal portion 1-2 is a vertical stopping plate, and a whole piece of high strength material is processed to form both of the transverse portion 1-1 and the longitudinal portion 1-2, which are formed as an integrated structure. The following materials can be used, for example, steel, iron, alloy and carbon fiber. If metal materials are used, a thermal refining may be performed on the metal materials to allow the tensile strength and yield strength thereof to meet a higher requirement.

For facilitating the installation, two sides of the transverse portion 1-1 in its width direction are each provided with an installation seat formed by a wing plate 1-3 extending outwardly. A thickness of the wing plate 1-3 is smaller than a thickness of the transverse portion 1-1, and is about one quarter to one half of the thickness of the transverse portion 1-1, and as shown in the drawings, the thickness of the wing plate 1-3 is one third of the thickness of the transverse portion 1-1. A top surface of the wing plate 1-3 and a top surface of the transverse portion 1-1 are located in the same plane. Viewed from a thickness direction of the longitudinal portion 1-2, the whole anti-derailment block 1 is in a shape of a letter T. Viewed from the top, a top surface of the whole anti-derailment block 1 is in a shape of a flat rectangle (or square).

Each of the wing plates 1-3 is provided with two countersunk bolt holes 1-4 spaced apart by a certain distance. The number of the bolt holes 1-4 is not limited herein, and can be three, four and even more, and may also be only one, according to different sizes and different installation requirements of the wing plate 1-3.

A width of an end portion of the longitudinal portion 1-2 is smaller than a width of a body portion of the longitudinal portion 1-2, and the end portion of the longitudinal portion 1-2 is in smooth transition with each of two lateral sides of the longitudinal portion 1-2 via a respective arc surface 1-5 (or an inclined surface). An inner side surface of the longitudinal portion 1-2 is a stopping surface 1-6, the stopping surface 1-6 inclines inward by 3 degrees to 5 degrees from an end portion to a root portion in a longitudinal direction, and an inclination angle $\alpha$ is hereby defined as 4 degrees which corresponds to an inclination angle $\beta$ of an inner side surface of a rail shoulder.

A lower surface of the transverse portion 1-1 is provided with an arc-shaped concave portion 1-7, and a radius R of the arc-shaped concave portion 1-7 is 80 mm, which is identical to a radian of a top surface of the rail, thus, a contact area between the anti-derailment block and a head portion of the rail is increased after the train is derailed. The concave portion 1-7 smoothly transits to the stopping surface 1-6 via a circular arc portion 1-8 at an intersection of the transverse portion 1-1 and the longitudinal portion 1-2. The intersection of the transverse portion and the longitudinal portion is a circular arc rather than a right angle, thus, on one hand, the stress concentration can be eliminated, and on the other hand, the stress intensity of the anti-derailment block can be improved, thereby avoiding an obvious deformation of the intersection when the anti-derailment block is subjected to a force.

As another form, the concave portion on the lower surface of the transverse portion may also transit all the way to the stopping surface 1-6 of the longitudinal portion, to form a curved surface portion together with the circular arc portion 1-8 at the intersection of the transverse portion 1-1 and the longitudinal portion 1-2, and the curved surface portion matches the shape of an outer shoulder of the rail.

Figure 3:
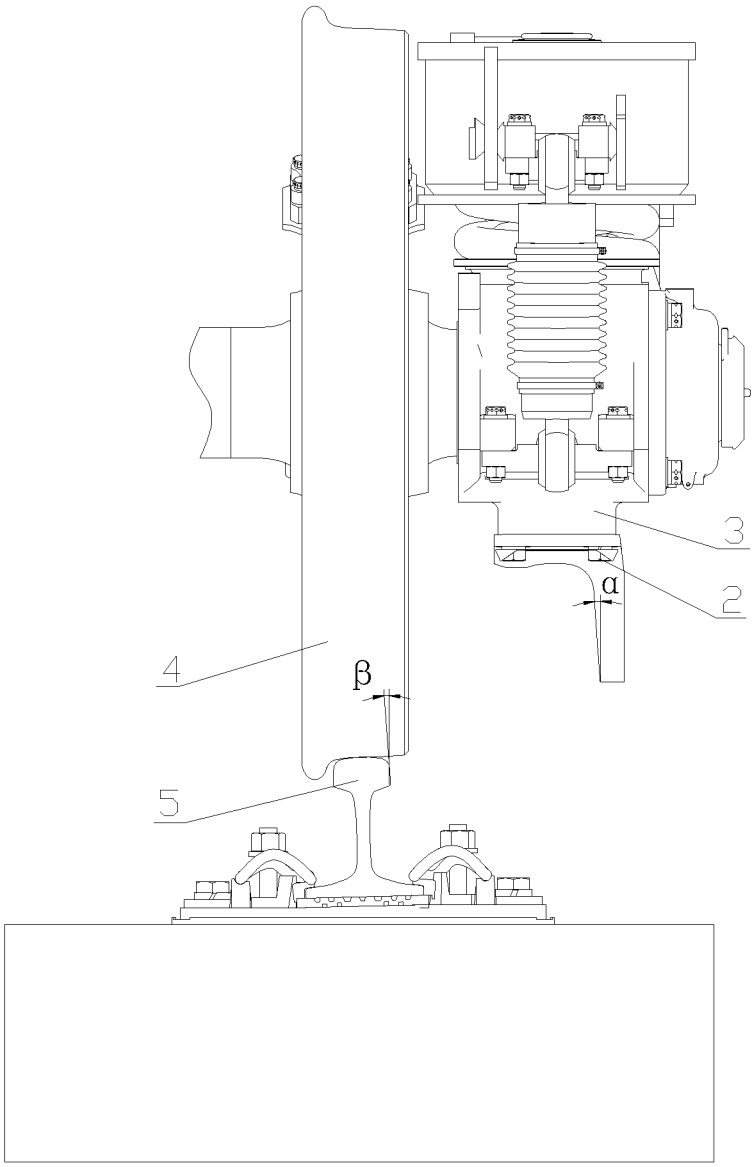
FIG. 3 is a schematic view showing a relative position among the anti-derailment safety device as shown in FIG. 2 on a bogie, an axle box body, a wheel and a rail, when a train is in a normal running state.
Figure 4:
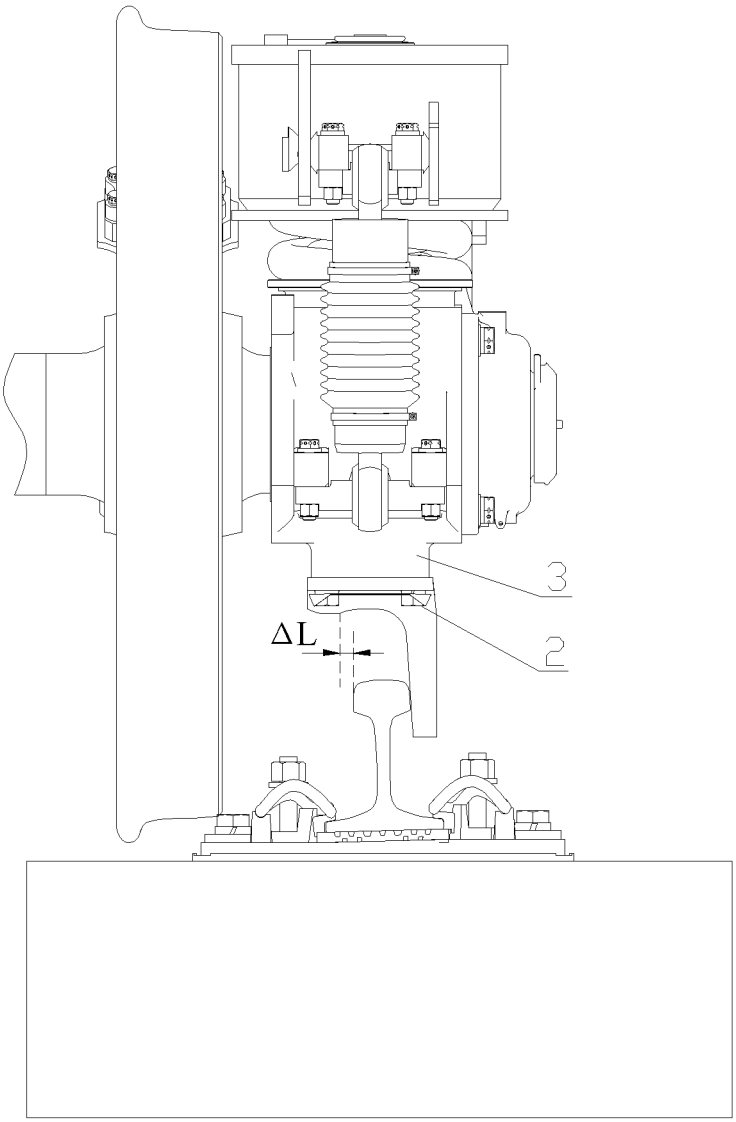
FIG. 4 is a schematic view showing a relative position among the components as shown in FIG. 3 after a derailment.

Reference is made to FIGS. 3 and 4. FIG. 3 is a schematic view showing a relative position among the anti-derailment safety device as shown in FIG. 2 on a bogie, an axle box body, a wheel and a rail, when a train is in a normal running state, and FIG. 4 is a schematic view showing a relative position among the components as shown in FIG. 3 after a derailment.

In use, the anti-derailment block is fixed at a lower portion of an axle box 3 by four bolts 2, and lower portions of two axle boxes 3 of the same wheel set are respectively provided with two anti-derailment blocks which are corresponding to a left wheel and a right wheel and are located outside the wheels. In space, the position of the anti-derailment block is kept a certain distance from all the components, for example, the wheel 4 and the rail 5. Therefore, the anti-derailment block does not contact the wheel and rail when the train runs normally, and only when the train is derailed, the anti-derailment block is in a sliding contact with the inner side surface of the rail shoulder.

For example, when the train is derailed to a left side, the left wheel is derailed to an outside of the left rail, the anti-derailment block located at the lower portion of the right axle box body comes into contact with the right rail. At this time, a distance between the left anti-derailment block and the left rail increases, and the left anti-derailment block does not take part in anti-derailment, vice versa.

The stopping surface 1-6 of the anti-derailment block and the outer side surface of the rail shoulder have the same inclined angle, thus they can fit closely with each other. Thus, on one hand, the train body can be prevented from further moving outward in a transverse direction, to restrain the position of the train from getting worse or prevent the train from getting overturned, and on the other hand, the train can be slowed down by a sliding friction force in the running direction of the train, to decrease a risk coefficient.

FIG. 3 shows a general derailment phenomenon or a preliminary stage of the derailment. In this case, the anti-derailment block limits the position of the train only by the contact between the stopping surface 1-6 thereof and the rail 5.

Figure 5:
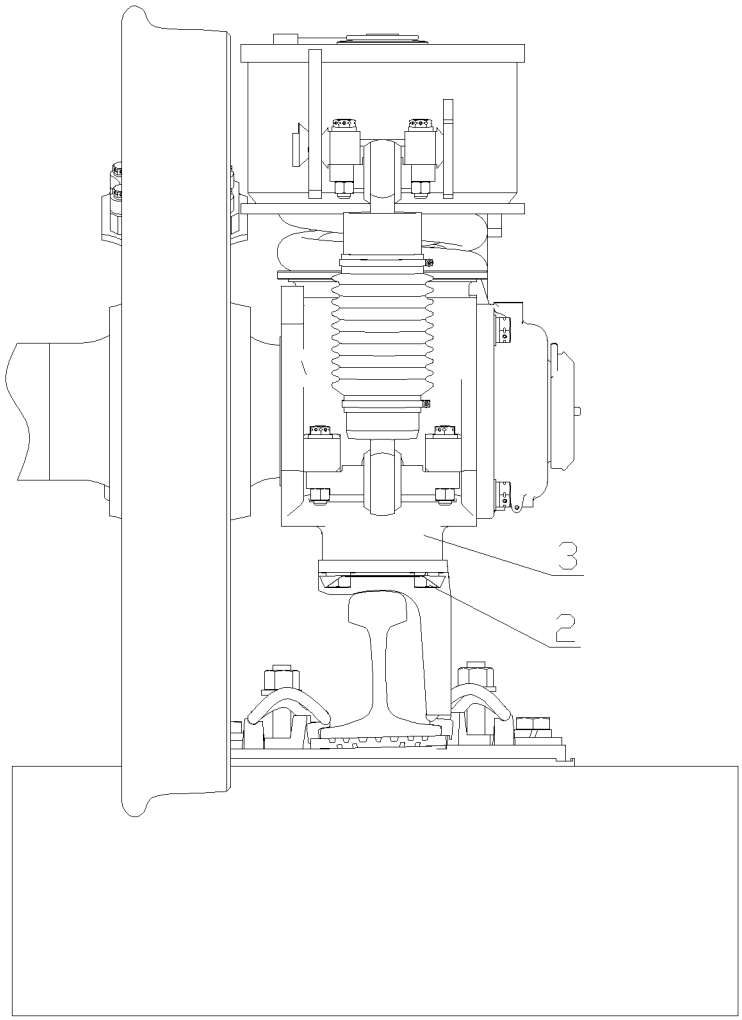
FIG. 5 is a schematic view showing a relative position among the components as shown in FIG. 3 after a further derailment.

Reference is made to FIG. 5. FIG. 5 is a schematic view showing a relative position among the components as shown in FIG. 3 after a further derailment.

When the phenomenon of derailment develops further, the wheel 4 may continue to sink. At this time, the top surface of the rail 5 may be fit into the concave portion 1-7 on the lower surface of the transverse portion 1-2 of the anti-derailment block, and the transverse portion 1-1 and the longitudinal portion 1-2 together limit the position of the train. The longitudinal portion 1-2 still restricts the train body from moving in the transverse direction, the transverse portion 1-1 restricts the train body from further moving downward, and the train is slowed down by the friction force in the running direction, thus the train can be effectively restricted in three dimensions at the most. Furthermore, the radian of the concave portion 1-7 is equal to the radian of the top surface of the rail 5, which can avoid damages to the rail.

Furthermore, as shown in FIG. 4, the concave portion 1-7 of the transverse portion 1-1 is not completely aligned with the top surface of the rail 5 in the vertical direction, and the concave portion 1-7 of the transverse portion 1-1 is spaced from the top surface of the rail 5 in a transverse direction by a certain distance ΔL. Because of the derailment, the concave portion 1-7 displaced transversely gets closer to the inner side and the rail gets closer to the outer side. In this way, during a process that the derailment develops from the state shown in FIG. 4 to the state shown in FIG. 5, the train body can be pulled back outward under a traction effect of the rail 5, to allow the train body to have a tendency of moving in a reverse transverse direction, to more effectively restrict the transverse displacement.

Under the premise of meeting the function requirement of preventing the derailment of the train, a structural design is conducted on the condition that a contact portion of the device and the rail is the most reasonable portion, to allow the device to have the minimum effect on the security of the rail. At the same time, boundary dimension of the device is optimized to meet the strength requirement for preventing the derailment of the train, and the anti-derailment device is installed at the lower portion of the axle box body by the bolted connection, thus is located within the gauge of the railway vehicle. The anti-derailment device has a simple structure, is easy to install and occupies a small space. The distance between the stopping surface and the outer side surface of the wheel and the distance between the stopping surface and the rail surface are safe and reasonable. In a normal state, the anti-derailment device does not contact the rail and does not affect the normal running of the train. Only when the train is derailed, the anti-derailment device contacts the rail, to effectively restrict the wheel set from further moving transversely and rolling laterally after the train is derailed, and effectively restrain the position of the derailed train from getting worse or prevent the derailed train from getting overturned.

The above embodiments are only preferable solutions of the present application, which are not limited herein. On this basis, specific adjustments can be made according to practical requirements to obtain different embodiments. For example, the transverse portion and the longitudinal portion of the anti-derailment block can be designed to have a separated structure, and then they can be connected as a whole by assembling or welding; or the anti-derailment block can be designed to have a shape similar to letter L, and so on. There are many implementation manners, thus will not be listed herein.

In addition to the above anti-derailment safety device, a railway vehicle is further provided according to the present application, and the railway vehicle includes a train body, a bogie and anti-derailment safety devices. The anti-derailment safety devices are the anti-derailment safety device described above, which are symmetrically fixed at the lower portion of the axle box body 3 of the bogie by bolts 2, and are located outside the wheels 4. In a height direction, the distance between a tail end of the longitudinal portion 1-2 and a top surface of the rail 5 (i.e., a rail surface) is 95 mm. The other structures can be referred to the conventional technology and are not described herein.

The railway vehicle and the anti-derailment safety device provided by the present application are described in detail hereinbefore. The principle and the embodiments of the present application are illustrated herein by specific examples. The above description of embodiments is only intended to help the understanding of the core concept of the present application. It should be noted that, for the person skilled in the art, many modifications and improvements may be made to the present application without departing from the principle of the present application, and these modifications and improvements are also deemed to fall into the scope of protection of the present application defined by the claims.

What is claimed is:

1. An anti-derailment safety device, wherein the anti-derailment safety device is in a shape of an inverted letter L, and comprises a transverse portion and a longitudinal portion perpendicular to the transverse portion at a side below the transverse portion; two sides of the transverse portion in a width direction of the transverse portion are each provided with an installation seat formed by a wing plate extending outwardly, and bolt holes are provided on the installation seat; and an inner side surface of the longitudinal portion is a stopping surface; and wherein a lower surface of the transverse portion is provided with a concave portion, a radian of a contact section of the concave portion is equal to a radian of a top surface of a rail, and the concave portion smoothly transits to the stopping surface by a circular arc portion at an intersection of the transverse portion and the longitudinal portion.

2. The anti-derailment safety device according to claim 1, wherein the transverse portion is a transverse stopping plate, the longitudinal portion is a vertical stopping plate, and the transverse stopping plate and the vertical stopping plate are formed as an integrated structure.

3. The anti-derailment safety device according to claim 2, wherein a thickness of the wing plate is smaller than a thickness of the transverse portion, and a top surface of the wing plate and a top surface of the transverse portion are located in a same plane.

4. The anti-derailment safety device according to claim 3, wherein the stopping surface-inclines inward by 3 degrees to 5 degrees in a longitudinal direction from an end portion to a root portion.

5. The anti-derailment safety device according to claim 4, wherein the stopping surface-inclines inward by 4 degrees in the longitudinal direction from the end portion to the root portion.

6. The anti-derailment safety device according to claim 4, wherein a width of an end portion of the longitudinal portion is smaller than a width of a body portion of the longitudinal portion, and a transition inclined surface or a transition arc surface is provided between the end portion of the longitudinal portion and each of lateral surfaces at two sides of the end portion.

7. The anti-derailment safety device according to claim 3, wherein a width of an end portion of the longitudinal portion is smaller than a width of a body portion of the longitudinal portion, and a transition inclined surface or a transition arc surface is provided between the end portion of the longitudinal portion and each of lateral surfaces at two sides of the end portion.

8. The anti-derailment safety device according to claim 2, wherein a width of an end portion of the longitudinal portion is smaller than a width of a body portion of the longitudinal portion, and a transition inclined surface or a transition arc surface is provided between the end portion of the longitudinal portion and each of lateral surfaces at two sides of the end portion.

9. The anti-derailment safety device according to claim 1, wherein a radius of the arc concave portion is 80 mm.

10. The anti-derailment safety device according to claim 1, wherein a width of an end portion of the longitudinal portion is smaller than a width of a body portion of the longitudinal portion, and a transition inclined surface or a transition arc surface is provided between the end portion of the longitudinal portion and each of lateral surfaces at two sides of the end portion.

11. A railway vehicle, comprising a train body, a bogie and anti-derailment safety devices, wherein the anti-derailment safety devices are the anti-derailment safety device according to claim 1, and the anti-derailment safety devices are symmetrically fixed at lower portions of axle box bodies of the bogie by bolts.

12. The railway vehicle according to claim 11, wherein in a height direction, a distance between a tail end of the longitudinal portion and a top surface of a rail ranges from 90 mm to 100 mm, inclusive.

* * * * *